US006810611B2

(12) United States Patent
Yarnall

(10) Patent No.: US 6,810,611 B2
(45) Date of Patent: Nov. 2, 2004

(54) BOBBLEHEAD PHOTOGRAPH FRAME

(75) Inventor: James Christpher Yarnall, Providence, RI (US)

(73) Assignee: Intercraft Company, Statesville, NC (US)

( * ) Notice: Subject to any disclaimer, the term of this patent is extended or adjusted under 35 U.S.C. 154(b) by 35 days.

(21) Appl. No.: 10/068,156

(22) Filed: Feb. 6, 2002

(65) Prior Publication Data

US 2003/0145501 A1 Aug. 7, 2003

(51) Int. Cl.[7] ..... G09F 19/08; A47G 1/06

(52) U.S. Cl. ..... 40/411; 40/725; 446/321; 446/100

(58) Field of Search ..... D6/305; 40/725, 40/744, 411; 446/100, 321

(56) References Cited

U.S. PATENT DOCUMENTS

| | | | | | |
|---|---|---|---|---|---|
| 2,199,049 | A | * | 4/1940 | Greenberg | 446/100 |
| 2,760,303 | A | * | 8/1956 | Del Mas | 446/97 |
| 5,141,466 | A | * | 8/1992 | Catizone | 446/391 |
| 5,255,457 | A | * | 10/1993 | Lipson | 40/744 |
| D348,293 | S | * | 6/1994 | Hodge | D21/630 |
| 6,511,359 | B1 | * | 1/2003 | Lui | 446/321 |

* cited by examiner

*Primary Examiner*—Cassandra H. Davis
(74) *Attorney, Agent, or Firm*—Marshall, Gerstein & Borun LLP

(57) ABSTRACT

A bobblehead has a body and head. The body and head are configured to represent a characteristic identified with people or animals. The characteristic, for example, may represent an occupation, an occasion, a hobby, or a fictional or other character. The head is configured to receive a photograph of a subject matching the characteristic.

14 Claims, 5 Drawing Sheets

FIG. 9
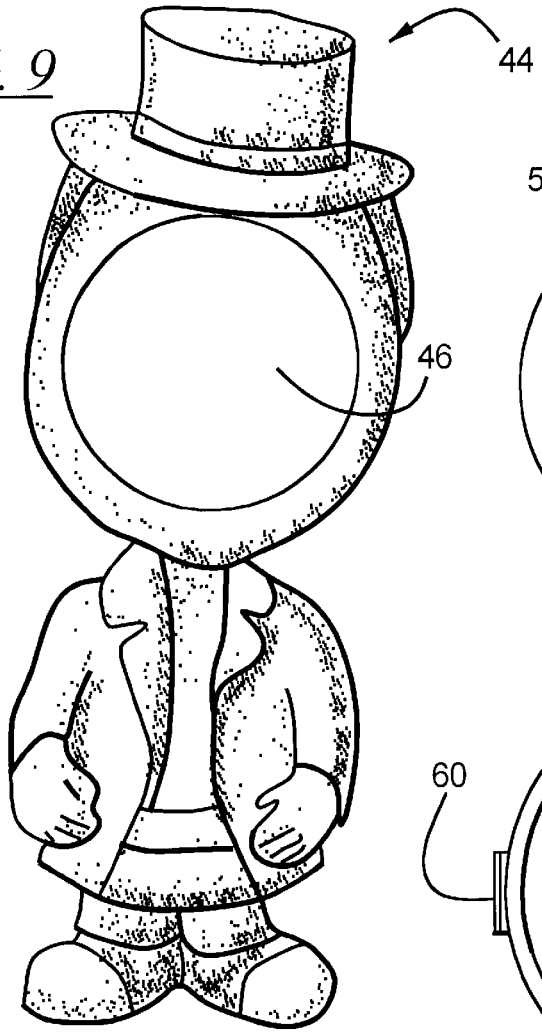
FIG. 10
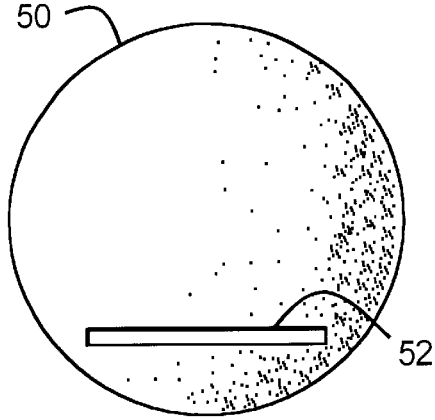
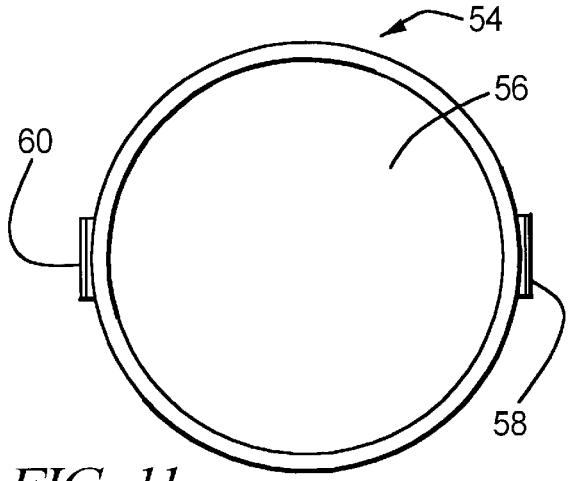
FIG. 11
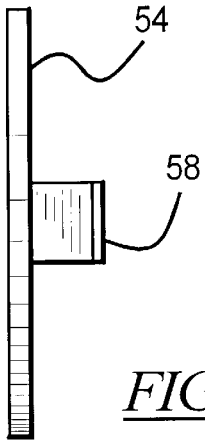
FIG. 12
FIG. 13
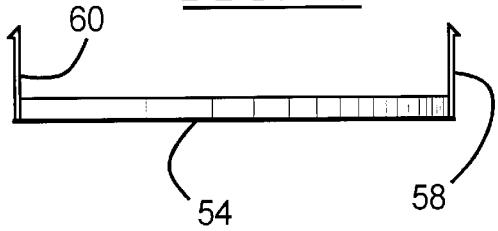

BOBBLEHEAD PHOTOGRAPH FRAME

TECHNICAL FIELD OF THE INVENTION

The present invention relates to bobbleheads and, more particularly, to bobbleheads that are arranged or configured to receive and hold photographs.

BACKGROUND OF THE INVENTION

Bobblehead dolls are figurines with typically oversized heads mounted by springs to corresponding bodies. Bobblehead dolls were popular in the 1960s and usually took the form of a little boy figure with a cherubic smile and a nodding head, and were designed to represent a baseball or football team. These early bobbleheads were typically made from papier-mache.

Bobbleheads are now back as irresistibly cute collectibles and are so popular that collectors often spend hours in line at stadiums and other outlets to snatch them up to add to their collections or to sell them during online auctions. Today, bobbleheads are typically molded poly-resin or ceramic dolls that resemble specific athletes right down to their distinctive earrings, 5 o'clock shadows, or tattoos. Former baseball great Willie Mays, current slugger Barry Bonds, and even famed manager Tommy Lasorda have been immortalized by bobbleheads. Basketball and hockey players and coaches are also commemorated by bobbleheads. Bobbleheads are in such demand that sport teams with traditionally poor attendance sell out seats on bobblehead giveaway nights. Although bobbleheads as giveaways can be expensive, the added ticket and concession sales resulting from these giveaways more than make up for the expense.

Bobbleheads are also made to resemble other beings such as golfers, policemen, college mascots, and clowns. Moreover, the spring-headed dolls have been made in the likenesses of icons like the Beatles, Fidel Castro and Colonel Sanders. Some bobbleheads have magnets or suction cups to be attached to dashboards or windows.

As can be seen, many of the existing bobbleheads represent specific people. While consumers may acquire them as collectibles, bobbleheads have had little meaning to consumers on a personal level. Thus, although consumers can relate to bobbleheads as they do with public figures in general, consumers cannot currently relate to bobbleheads in a deeply private and individual way.

Other bobbleheads represent people generically. Thus, while a bobblehead may represent a policeman, such a bobblehead does not portray a specific individual who happens to be a policeman. Accordingly, this type of bobblehead is not personalized in any way.

The present invention allows bobbleheads to be related to consumers in a much more personal and individual way than has heretofore been known.

SUMMARY OF THE INVENTION

In accordance with one aspect of the present invention, a bobblehead comprises a body and head, and the head is configured to receive a photograph.

In accordance with another aspect of the present invention, a bobblehead comprises a body and head. The body and head are configured to represent a characteristic identified with a person or animal, and the head is configured to receive a photograph of a subject matching the characteristic.

In accordance with still another aspect of the present invention, an apparatus comprises a bobblehead and a photograph. The bobblehead includes a body and a head. The body is configured to personify a personal attribute, the head is configured to receive the photograph, and the photograph matches the personal attribute.

In accordance with yet another aspect of the present invention, a method comprises the following: selecting a bobblehead having a body and a head personifying a personal characteristic, wherein the bobblehead is arranged to receive and hold a photograph; and, applying the photograph to the bobblehead such that the photograph is of a subject matching the personal characteristic.

In accordance with a further aspect of the present invention, a method comprises the following: offering a first bobblehead configured according to a first subject, wherein the first bobblehead is arranged to receive and hold a first photograph permitting the first photograph to have a content matching the first subject; offering a second bobblehead configured according to a second subject, wherein the second bobblehead is arranged to receive and hold a second photograph permitting the second photograph to have a content matching the second subject; and, offering a third bobblehead configured according to a third subject, wherein the third bobblehead is arranged to receive and hold a third photograph permitting the third photograph to have a content matching the third subject, and wherein the first, second, and third subjects are different.

In accordance with yet a further aspect of the present invention, a bobblehead comprises a body and a head. The head is configured to receive a photograph, and the head moves so as to provide animation to the photograph.

In accordance with a still further aspect of the present invention, a figurine comprises a body and head, and the head is configured to receive a photograph.

BRIEF DESCRIPTION OF THE DRAWINGS

These and other features and advantages will become more apparent from a detailed consideration of the invention when taken in conjunction with the drawings in which:

FIG. 9 illustrates a bobblehead in the figure of a groom; and,

FIGS. 10–13 illustrate various techniques for securing a photograph to the bobblehead of the present invention.

DETAILED DESCRIPTION

The bobbleheads shown in FIGS. 1–9 are illustrative of various subjects such as human related activities or associations. Each of these bobbleheads has a blank face that is arranged to receive a photograph. The photograph can be of family member, a pet, a friend, etc. The bobblehead design can be selected to match the person or animal whose photograph is to be placed in the blank face of the selected bobblehead.

Figure 1:
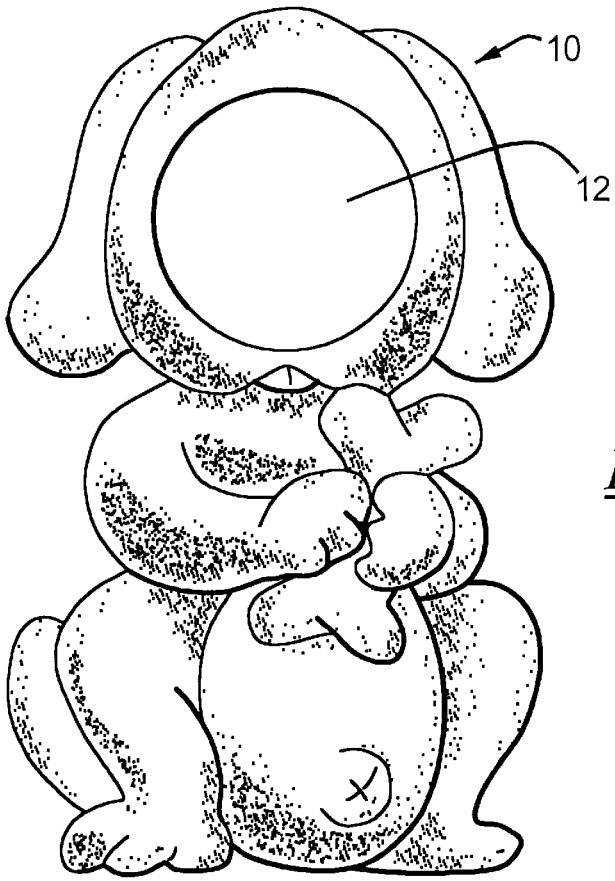
FIG. 1 illustrates a bobblehead in the figure of a dog.

For example, FIG. 1 illustrates a bobblehead 10 having a blank face 12. The-bobblehead 10 is modeled after a dog.

Figure 2:
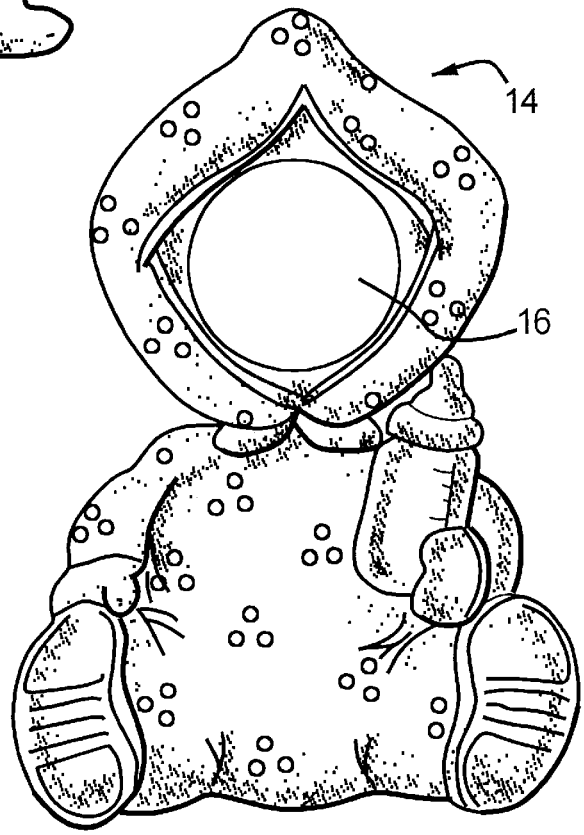
FIG. 2 illustrates a bobblehead in the figure of a baby.
Figure 3:
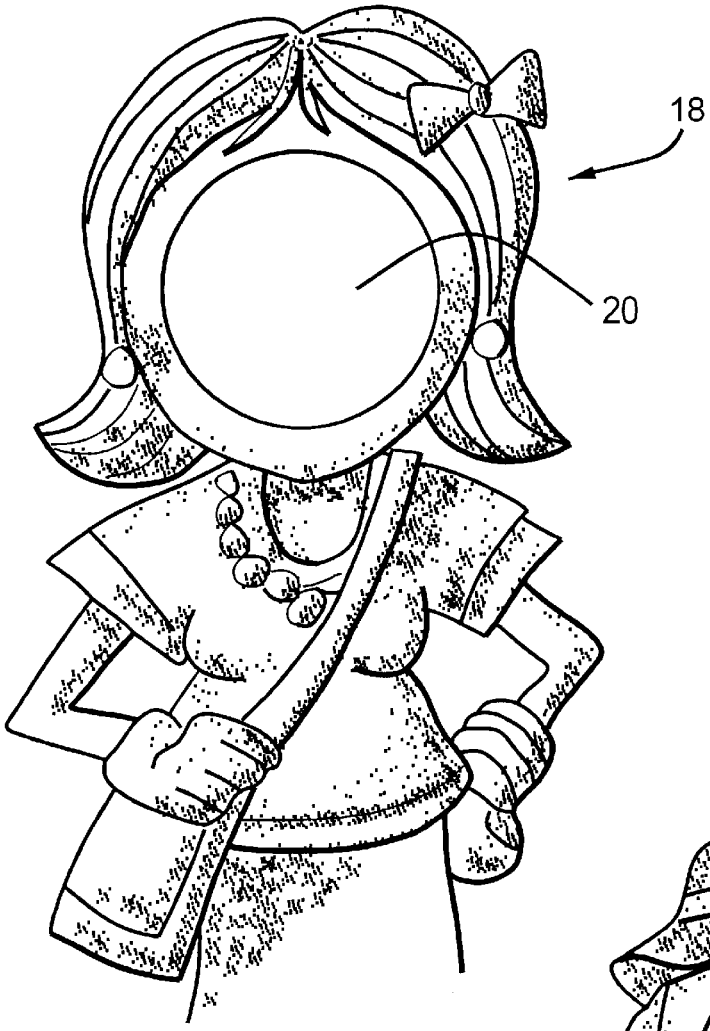
FIG. 3 illustrates a bobblehead in the figure of a teenage girl.

Therefore, a consumer who acquires the bobblehead 10 might want to apply a photograph of a pet dog to the blank face 12. FIG. 2 illustrates a bobblehead 14 having a blank face 16. The bobblehead 14 is modeled after a baby. Therefore, a photograph of baby can be applied to the blank face 16. FIG. 3 illustrates a bobblehead 18 having a blank face 20. The bobblehead 18 is modeled after a teenage girl. Therefore, the owner of the bobblehead 18 might want to apply a photograph of a teenage daughter, niece, or friend to the blank face 20.

Figure 4:
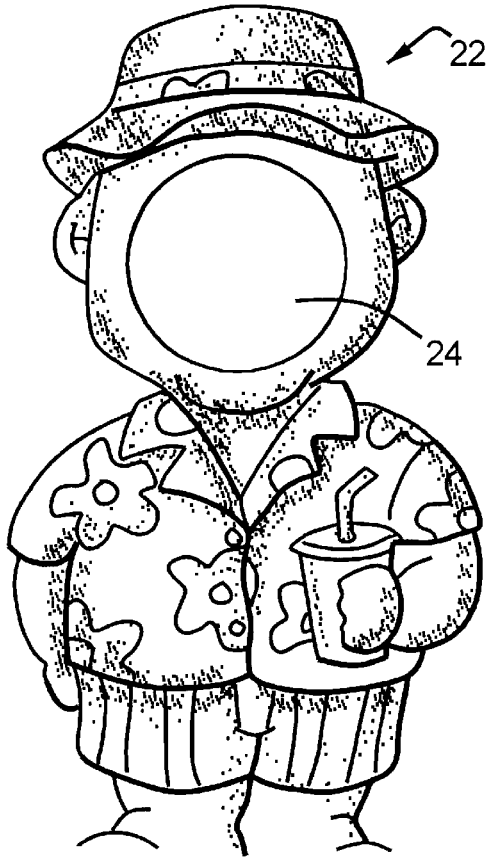
FIG. 4 illustrates a bobblehead in the figure of a man with a drink.
Figure 5:
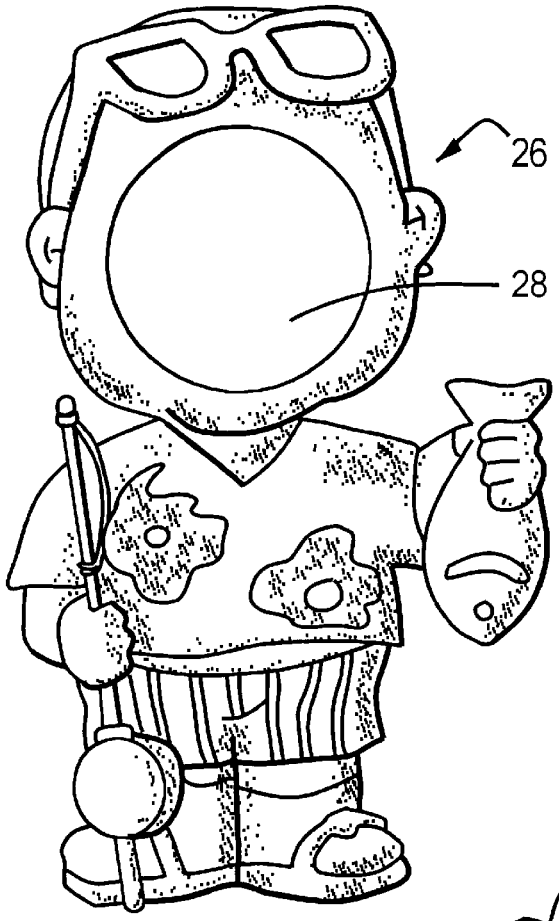
FIG. 5 illustrates a bobblehead in the figure of a fisherman.
Figure 6:
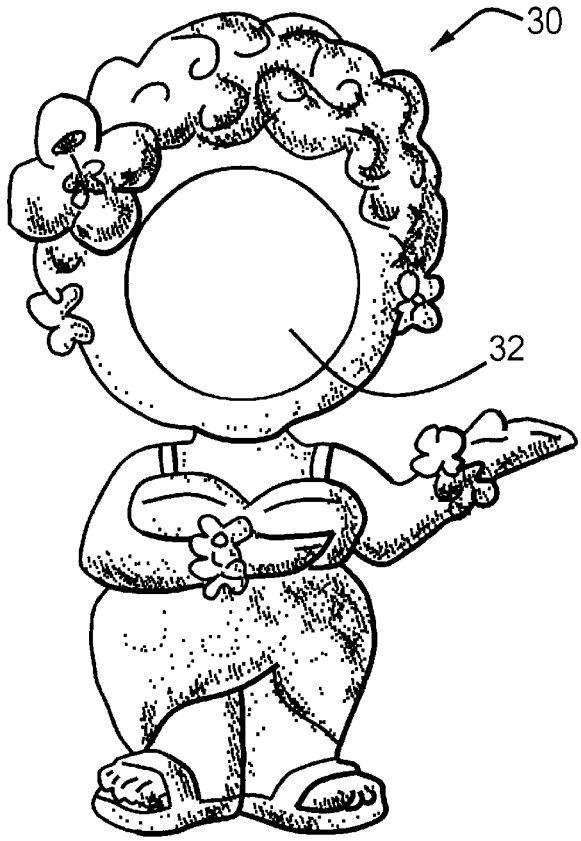
FIG. 6 illustrates a bobblehead in the figure of a hula woman.

Similarly, FIG. 4 illustrates a bobblehead 22 having a blank face 24. The bobblehead 22 is modeled after a man with a drink. Therefore, the owner of the bobblehead 22 might want to apply a photograph of a father, husband, son, uncle, nephew, or friend to the blank face 24. FIG. 5 illustrates a bobblehead 26 modeled after a fisherman. Therefore, the owner of the bobblehead 26 might want to apply a photograph of a person whose hobby or occupation is fishing to the blank face 28. FIG. 6 illustrates a bobblehead 30 having a blank face 32. The bobblehead 30 is modeled after a woman doing the hula dance. Therefore, the owner of the bobblehead 30 might want to apply a photograph of a family member or friend who is about to go or who has been to a Pacific island to the blank face 32.

Figure 7:
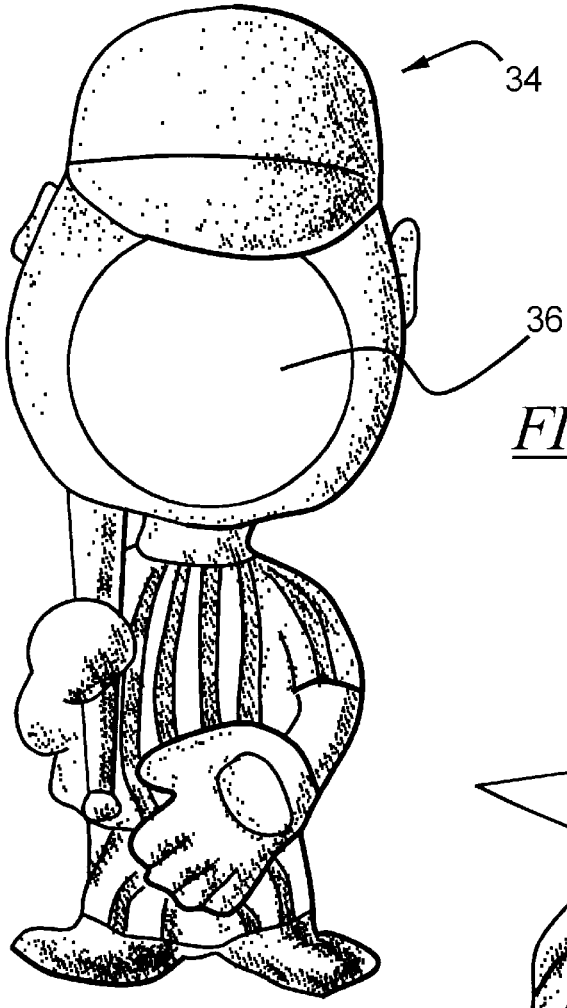
FIG. 7 illustrates a bobblehead in the figure of a baseball player.
Figure 8:
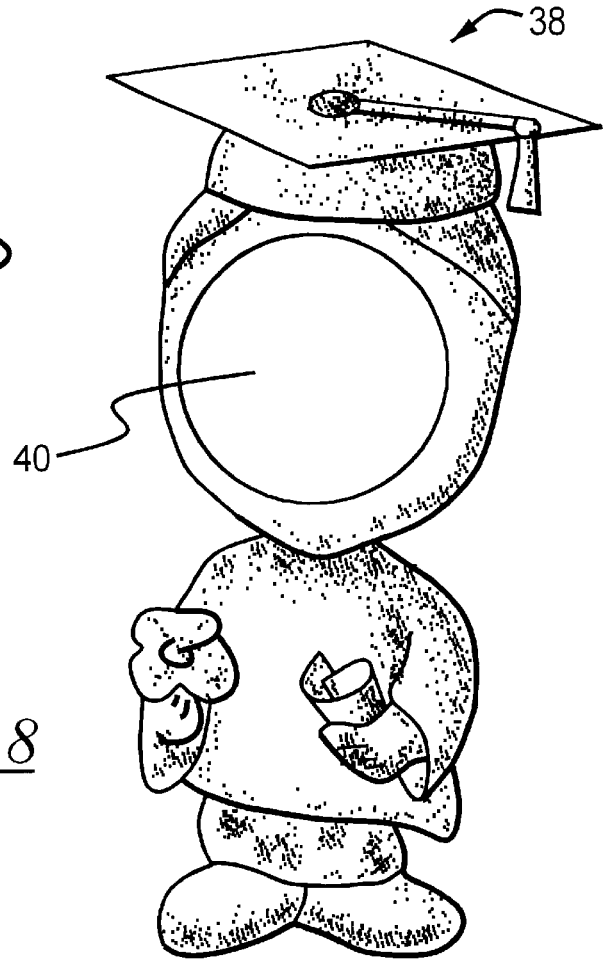
FIG. 8 illustrates a bobblehead in the figure of a graduate.

FIG. 7 illustrates a bobblehead 34 having a blank face 36. The bobblehead 34 is modeled after a baseball player. Therefore, the owner of the bobblehead 34 might want to apply a photograph of a family member or friend who is a baseball player to the blank face 36. FIG. 8 illustrates a bobblehead 38 having a blank face 40. The bobblehead 38 is modeled after a graduate. Therefore, the owner of the bobblehead 38 might want to apply a photograph of a family member or friend who has recently graduated to the blank face 40. FIG. 9 illustrates a bobblehead 44 having a blank face 46. The bobblehead 44 is modeled after a groom. Therefore, the owner of the bobblehead 44 might want to apply a photograph of a son, brother, or friend who has recently been married to the blank face 46.

As can be seen, the blank faces of these bobbleheads allow the bobbleheads to be personalized by matching a person or animal to the specific theme of the bobblehead. By attaching an appropriate photograph to the blank face of a bobblehead having a matching theme, the bobblehead can be personalized and individualized in a way not previously known.

A photograph can be attached to the blank face of a bobblehead in any number of ways. For example, an adhesive may be used to attach a photograph to the blank face of a bobblehead. The adhesive may be applied to either the blank face or the photograph and may be in the form of glue, double-sided tape, or the like. The adhesive may be light such as used on sticky notes so that photographs can be easily removed and replaced.

Alternatively, as shown in FIG. 10, the top or side of a head 50 of a bobblehead may be provided with a slot 52 through which a photograph may be slid so that the photograph covers the blank face.

As another alternative shown in FIGS. 11, 12, and 13, a ring 54 may be used to secure a photograph to a blank face of a bobblehead. The ring 54 is formed with a blank center 56 that aligns with the blank face of a bobblehead when the ring 54 is secured to the head of a bobblehead. The ring 54 is provided with tabs 58 and 60 that fit into corresponding slots in the head of bobblehead. Accordingly, a photograph can be placed over the blank face of a bobblehead and is secured thereto by the ring 54 when the tabs are snapped into the corresponding slots. The slots can be accessible through the head of the bobblehead. Accordingly, the tabs 58 and 60 can be depressed toward each other as viewed in FIG. 13 so that the tabs 58 and 60 disengage the head in order to remove the ring 54 from the bobblehead when the photograph is to be changed.

As still another alternative, the ring 54 may be provided with threads instead of the tabs 58 and 60 so that the ring 54 may be threaded onto the head of a bobblehead to thereby secure a photograph thereto. However, screws or other fastening devices may be used instead to secure the ring 54 to the head of a bobblehead.

As yet another alternative, the ring 54 may be hinged to the bobblehead so that the ring 54 can be opened to permit application of a photograph to the bobblehead and can be then closed and secured in order to affix the photograph to the bobblehead.

As a further alternative, the ring 54 may be arranged to interact magnetically with the bobblehead in order to secure a photograph to the bobblehead.

As a still further alternative, the bobblehead may have a blank face covered by a piece of transparent plastic or glass or acetate that can be removed when a photograph is to be placed on the blank face, and that can be reapplied to the bobblehead in order to secure the photograph to the bobblehead. The piece of plastic or glass or acetate may be secured to the bobblehead with tabs that attached to the bobblehead or by the ring 54 or by screws or other fastening devices. On the other hand, the piece of plastic or glass or acetate may have tabs that can be gripped to facilitate its removal from a bobblehead and may have a notch that interacts with the bobblehead in order to secure a photograph to the blank face.

Accordingly, any entity or person along the distribution chain of the bobbleheads of the present invention are in a position to offer a first bobblehead having a body and a head configured according to a first subject. The first bobblehead is arranged to receive and hold a first photograph permitting the first photograph to have a content matching the first subject. The entity or person can also offer a second bobblehead having a body and a head configured according to a second subject. The second bobblehead is arranged to receive and hold a second photograph permitting the second photograph to have a content matching the second subject. The entity or person can likewise offer a third bobblehead having a body and a head configured according to a third subject. The third bobblehead is arranged to receive and hold a third photograph permitting the third photograph to have a content matching the third subject.

The first, second, and third subjects may all be different. For example, the first subject may be a sporting activity such as baseball where the bobblehead is configured as a baseball player (or other hobby or profession). Accordingly, a family having a son or daughter playing baseball may apply a photograph of the son or daughter to the bobblehead configured as a baseball player. The second subject may be animal related where the bobblehead is configured as a pet such as a dog or cat. Accordingly, a person having a pet may apply a photograph of the pet to the bobblehead configured as an animal. The third subject may be an occasion such as graduation where the bobblehead is configured as a graduate. Accordingly, a person having a relative or friend who will graduate or has graduated may apply a photograph of that relative or friend to the bobblehead configured as a graduate.

Additional bobbleheads may likewise be offered. For example, a bobblehead may be configured to represent an occupation such as policeman or doctor. Accordingly, a person having a relative or friend who is a policeman or doctor may apply a photograph of that relative or friend to a bobblehead configured as the corresponding occupation. As another example, a bobblehead may be configured to represent an interest or a character such as an action figure. Accordingly, a person having a relative or friend who likes that action figure may apply a photograph of that relative or friend to a bobblehead configured as the corresponding action figure. As a still further example, a bobblehead may be configured to represent a seasonal character such as a witch at Halloween. Accordingly, a person having a relative or friend who dressed for Halloween as a witch may apply a photograph of that relative or friend to a bobblehead configured as the corresponding seasonal character.

As will be understood from the description above, the bobbleheads of the present invention are collectibles as are the bobbleheads of the prior art. However, the bobbleheads of the present invention may be personalized in a way that the bobbleheads of the prior art could not. Thus, a photograph of a person can be applied to a bobblehead that is configured to match an activity or other personal characteristic of the person in the photograph. This attribute of the bobbleheads of the present invention permits a familiarity and personalization not known with prior art bobbleheads.

Moreover, the bobbleheads of the present invention are more than collectibles in that they have a practical use in storing and displaying photographs that otherwise would need a storage container such as an album or frame. Thus, the bobbleheads of the present invention go beyond the collectible purpose of the prior art.

A bobblehead of the present invention may be provided with a magnet, a suction cup, or other fastening device that permits the bobblehead to be attached to a surface of a car, a boat, or other vehicle. The design of the body gives the bobblehead the stability to enable the bobblehead to be used while such a vehicle is moving, and the design of the head enables the bobblehead to be personalized with a photograph. The combination of this bobblehead body and head provides both a personalized collectible and the ability to display a photograph in a moving vehicle.

The bobbleheads of the present invention may be used as more than collectibles in that they can match and emphasize the theme or decor or the use of the spaces in which they are used. Thus, a bobblehead cannot only be selected to match the person or animal whose photograph is to be placed in the blank face, but it can also be selected to complement the decor of a living space. For example, the bobblehead 14 of FIG. 2 is modeled after a baby. Applying a photograph of a baby to the blank face 16 and then placing the bobblehead 14 in the baby's nursery will personalize the room and emphasize its use as prior known collectibles cannot. As another example, the bobblehead 34 is modeled after a baseball player. Applying a photograph of a person who plays baseball to the blank face 36 of the bobblehead 34 can personalize the room of that person and also emphasize a baseball theme of that person's room.

Certain modifications of the present invention have been discussed above. Other modifications of the present invention will occur to those practicing in the art of the present invention. For example, although bobbleheads configured to represent certain specific subjects have been described above with respect to FIGS. 1–9, bobbleheads can be configured to represent other subjects as well.

Moreover, other types of figurines may be provided with blank faces and may be configured according to various subjects so that photographs having content matching the subject can be applied to the blank face.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

I claim:

1. A bobblehead comprising a body and head, wherein the head is configured to receive a photograph, and wherein the head includes a detachable photo holder comprising a ring so as to hold the photograph in a facial area of the head.

2. A bobblehead comprising a body and head, wherein the body and head are configured to represent a characteristic identified with a person or animal, wherein the head is configured to receive a photograph of a subject matching the characteristic, and wherein the head includes a detachable photo holder comprises a ring so as to hold the photograph in a facial area of the head.

3. An apparatus comprising a bobblehead and a photograph, wherein the bobblehead comprises a body and a head, wherein the body is configured to personify a personal attribute, wherein the head is configured to receive the photograph, wherein the photograph matches the personal attribute, and wherein the head includes a detachable photo holder comprises a ring so as to hold the photograph in a facial area of the head.

4. A method comprising:

selecting a bobblehead having a body and a head personifying a personal characteristic, wherein the bobblehead is arranged to receive and hold a photograph; and applying the photograph to the bobblehead such that the photograph is of a subject matching the personal characteristic, wherein the applying of a photograph to the bobblehead comprises applying the photograph to the bobblehead using a detachable photo holder comprises a ring.

5. A photograph display device comprising:

a body;

a bobblehead operatively attached to and resiliently movable relative to the body, wherein the bobblehead is adapted to receive a photograph; and a fastening device for attaching the photograph display device to an object wherein the fastening device is a magnet.

6. A photograph display device comprising:

a body;

a bobblehead operatively attached to and resiliently movable relative to the body, wherein the bobblehead is adapted to receive a photograph; and a fastening device for attaching the photograph display device to an object wherein the fastening device is a suction cup.

7. A photograph display device comprising:

a body;

a bobblehead operatively attached to and resiliently movable relative to the body, wherein the bobblehead is adapted to receive a photograph; and a slot through which the photograph can be inserted so as to be held in a facial area of the bobblehead.

8. A photograph display device comprising:

a body;

a bobblehead operatively attached to and resiliently movable relative to the body, wherein the body and bobblehead are configured to represent a characteristic identified with one of a person and animal, and wherein the bobblehead is configured to receive a photograph of a subject matching the characteristic; and a fastening device for attaching the photograph display device to an object.

9. The photograph display device of claim 8, wherein the fastening device is a magnet.

10. The photograph display device of claim 8, wherein the fastening device is a suction cup.

11. The photograph display device of claim 8, wherein the body and bobblehead are configured to represent one of an occupation, an activity, a fictional character, and a seasonal character.

12. A photograph display device comprising:

a body;

a bobblehead operatively attached to and resiliently movable relative to the body, wherein the body and bobblehead are configured to represent a characteristic identified with one of a person and animal, and wherein the bobblehead is configured to receive a photograph of a subject matching the characteristic; and a slot through which the photograph can be inserted so as to be held in a facial area of the bobblehead.

13. A method of displaying photographs, the method comprising:

providing one or more photograph display devices each having a body and a bobblehead operatively attached to and resiliently movable relative to the body, wherein the bobblehead is adapted to receive a photograph; and securing a picture to the bobblehead of the one or more devices wherein securing the picture to the bobblehead includes inserting the picture through a slot in the bobblehead.

14. A method of displaying photographs, the method comprising:

providing one or more photograph display devices each having a body and a bobblehead operatively attached to and resiliently movable relative to the body, wherein the bobblehead is adapted to receive a photograph; and securing a picture to the bobblehead of the one or more devices wherein securing the picture to the bobblehead includes securing a ring to the bobblehead.

* * * * *